US008579691B2

(12) United States Patent
Jones et al.

(10) Patent No.: US 8,579,691 B2
(45) Date of Patent: Nov. 12, 2013

(54) GAMING SYSTEM

(75) Inventors: Michael Ian Jones, Matraville (AU); Lynne Cheryl Oldfield, Stanmore (AU)

(73) Assignee: Aristocrat Technologies Australia Pty Limited (AU)

( * ) Notice: Subject to any disclaimer, the term of this patent is extended or adjusted under 35 U.S.C. 154(b) by 706 days.

(21) Appl. No.: 12/139,247

(22) Filed: Jun. 13, 2008

(65) Prior Publication Data

US 2009/0005160 A1 Jan. 1, 2009

(30) Foreign Application Priority Data

Jun. 28, 2007 (AU) ..... 2007903499
Jan. 14, 2008 (AU) ..... 2008900164

(51) Int. Cl.
*A63F 9/24* (2006.01)

(52) U.S. Cl.
USPC ..... 463/17

(58) Field of Classification Search
USPC ..... 463/17
See application file for complete search history.

(56) References Cited

U.S. PATENT DOCUMENTS

| | | | | |
|---|---|---|---|---|
| 5,909,875 | A | 6/1999 | Weingardt | |
| 6,102,400 | A | 8/2000 | Scott et al. | |
| 6,527,175 | B1 | 3/2003 | Dietz et al. | |
| 6,786,824 | B2 * | 9/2004 | Cannon | 463/16 |
| 6,913,534 | B2 * | 7/2005 | DeFrees-Parrott et al. | 463/17 |
| 7,169,041 | B2 * | 1/2007 | Tessmer et al. | 463/16 |
| 2001/0034263 | A1 | 10/2001 | Roberts | |
| 2001/0036855 | A1 | 11/2001 | DeFrees-Parrott et al. | |
| 2002/0093136 | A1 | 7/2002 | Moody | |
| 2003/0069059 | A1 | 4/2003 | Stanek | |
| 2003/0104857 | A1 | 6/2003 | Jenkins | |
| 2003/0157979 | A1 | 8/2003 | Cannon et al. | |
| 2005/0096130 | A1 | 5/2005 | Mullins | |
| 2005/0107153 | A1 | 5/2005 | Jubinville et al. | |
| 2005/0165619 | A1 | 7/2005 | Wright | |
| 2005/0208990 | A1 | 9/2005 | Moore | |
| 2006/0071046 | A1 | 4/2006 | Roberts et al. | |
| 2006/0094507 | A1 | 5/2006 | Iwamoto | |
| 2006/0100008 | A1 | 5/2006 | Wright et al. | |
| 2006/0160597 | A1 | 7/2006 | Wright | |
| 2012/0302311 | A1 * | 11/2012 | Luciano, Jr. | 463/17 |

FOREIGN PATENT DOCUMENTS

| | | | |
|---|---|---|---|
| GB | 1559496 | | 1/1980 |
| GB | 2393015 | | 3/2004 |
| GB | 2417430 | A | 3/2006 |
| JP | 2004242825 | A | 9/2004 |
| JP | 2004242826 | A | 9/2004 |
| JP | 2005192845 | A | 7/2005 |
| JP | 2005312780 | A | 11/2005 |
| JP | 2005348829 | A | 12/2005 |
| JP | 2006034424 | A | 2/2006 |
| JP | 2006158436 | A | 6/2006 |
| WO | 0176708 | A1 | 10/2001 |
| WO | 02094400 | A1 | 11/2002 |
| WO | 2005075039 | A1 | 8/2005 |
| WO | 2006081022 | A2 | 8/2006 |
| WO | WO 2007011557 | | 1/2007 |

* cited by examiner

*Primary Examiner* — Xuan Thai
*Assistant Examiner* — Michael Grant
(74) *Attorney, Agent, or Firm* — McAndrews, Held & Malloy, Ltd.

(57) ABSTRACT

A ticket management system (10) for a gaming system is disclosed. The ticket management system comprises at least one gaming machine (12) and is arranged to allocate tickets (22) to at least one gaming machine (12) in accordance with at least one allocation criterion (36). An award is provided to a player of a gaming machine (12) when a ticket allocated to the gaming machine corresponds to a winning outcome.

22 Claims, 4 Drawing Sheets

GAMING SYSTEM

RELATED APPLICATIONS

This application claims priority to Australian Provisional Patent Application No. 2007903499, having a filing date of Jun. 28, 2007, and Australian Provisional Patent Application 2008900164, having a filing date of Jan. 14, 2008, entitled "A Gaming System," which is hereby incorporated by reference herein in its entirety.

FIELD OF THE INVENTION

The present invention relates to a gaming system, to a ticket management system for a gaming system, and to a method of gaming.

BACKGROUND OF THE INVENTION

It is known to provide a gaming system which includes a plurality of gaming machines arranged such that each gaming machine contributes a proportion of game turnover to a progressive jackpot. In one variation, a prize is awarded to a player of a gaming machine when the gaming machine displays a particular game outcome. In an alternative variation, a prize is awarded when the jackpot amount reaches a threshold amount, with the player of the gaming machine causing the threshold to be exceeded being awarded a prize.

However, while gaming systems including such progressive jackpots provide users with enjoyment, a need exists for alternative gaming systems in order to maintain or increase player enjoyment.

BRIEF SUMMARY OF THE INVENTION

In accordance with a first aspect of the present invention, there is provided a gaming system comprising:

at least one gaming machine; and a ticket management system arranged to allocate tickets to at least one gaming machine in accordance with at least one allocation criterion;

the gaming system being arranged to provide an award to a player of a gaming machine when a ticket allocated to the gaming machine corresponds to a winning outcome.

The award may be a monetary prize, at least one feature award, or at least one free game.

The ticket may be printed by the gaming machine, for example in the form of a scratch card, or may be a virtual ticket.

In an embodiment wherein the ticket is printed, at least one ticket may include information indicative of whether the ticket corresponds to a winning outcome, and may include information indicative of an award such that allocation of the ticket to a gaming machine provides an award to a player of the gaming machine.

In one embodiment, the ticket management system is arranged to allocate a ticket to a gaming machine when the turnover of the gaming machine reaches a turnover milestone, or each time the turnover of the gaming machine reaches one of a plurality of turnover milestones.

In an alternative embodiment, the ticket management system is arranged to allocate a ticket to a gaming machine when a specific number of games have been played by the gaming machine.

In an alternative embodiment, the ticket management system is arranged to allocate a ticket to a gaming machine when a specific game outcome occurs, for example based on one or more winning outcomes at the gaming machine.

In one embodiment, the ticket management system is arranged to allocate a ticket to a gaming machine when a special bet is placed.

In one embodiment, the ticket management system is arranged to allocate a ticket to a gaming machine when a specific period of time has elapsed since allocation of a ticket or since at least one ticket was drawn.

In one arrangement, the gaming system comprises a prize pool and the ticket management system is arranged so as to increase the prize pool as the number of allocated tickets increases. Each gaming machine may contribute a credit amount to the prize pool when a ticket is allocated to the gaming machine.

In one embodiment, the gaming system comprises a plurality of gaming machines and the ticket management system is arranged to:

allocate tickets to at least some of the gaming machines in accordance with at least one allocation criterion; and draw at least one ticket when at least one draw criterion is satisfied, the or each drawn ticket corresponding to a winning outcome.

The ticket management system may be arranged to draw at least one ticket when the prize pool reaches a specific amount, or when the prize pool reaches a pseudo randomly selected amount.

In an alternative arrangement, the ticket management system may be arranged to draw at least one ticket when a specific number of tickets less than the total number of available tickets have been allocated, or when a pseudo randomly selected number of tickets less than the total number of available tickets have been allocated.

In an alternative embodiment, the ticket management system is arranged to draw at least one ticket when a specific period of time has elapsed since a ticket was drawn.

In an alternative arrangement, the gaming system may be arranged such that for n successive ticket draws the ticket management system is arranged to draw at least one ticket when a specific number of tickets less than the total number of available tickets have been allocated, and for an (n+1)th ticket draw the ticket management system is arranged to draw at least one ticket when all available tickets have been allocated.

The ticket management system may be arranged to control and coordinate operations in the ticket management system, and may comprise a ticket memory arranged to store tickets.

The ticket control unit may comprise a processor and a control unit memory arranged to store programs, allocation criteria and draw criteria usable by the control unit.

In accordance with a second aspect of the present invention, there is provided a ticket management system arranged to allocate tickets to at least one gaming machine in accordance with at least one allocation criterion;

wherein an award is provided to a player of a gaming machine when a ticket allocated to the gaming machine corresponds to a winning outcome.

In accordance with a third aspect of the present invention, there is provided a method of gaming comprising:

providing at least one gaming machine;

allocating at least one ticket to at least one gaming machine in accordance with at least one allocation criterion; and awarding a prize to a player of a gaming machine when a ticket allocated to the gaming machine corresponds to a winning outcome.

BRIEF DESCRIPTION OF SEVERAL VIEWS OF THE DRAWINGS

The present invention will now be described, by way of example only, with reference to the accompanying drawings, in which.

DETAILED DESCRIPTION OF THE INVENTION

Figure 1:
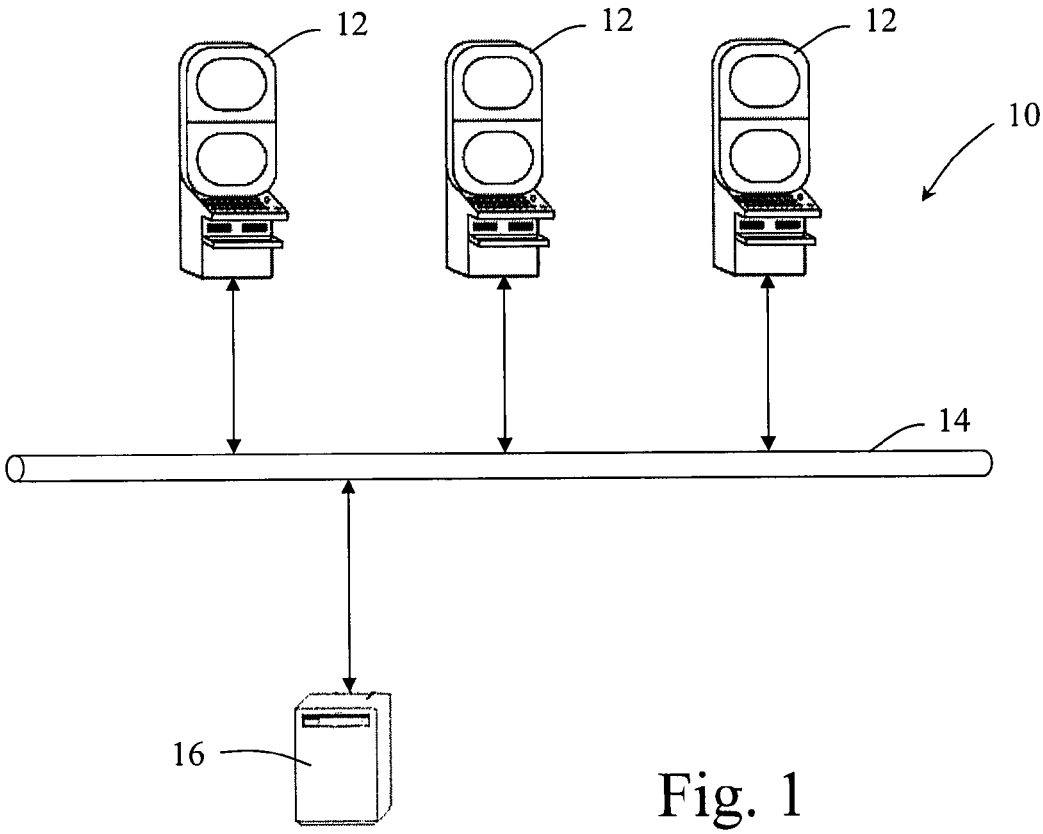
FIG. 1 is a diagrammatic block diagram of a gaming system in accordance with an embodiment of the present invention.

Referring to the drawings, there is shown a gaming system 10 which comprises a plurality of gaming machines 12 connected through a gaming network 14 to a ticket management system 16 arranged to control and coordinate distribution of tickets. In this embodiment, the ticket management system 16 implements a lottery in which the gaming machines 12 participate, so that players of the gaming machines 12 have an opportunity to win a prize associated with the lottery.

Each ticket 22 is allocatable to a gaming machine 12 based on at least one ticket allocation criterion. For example, a ticket may be allocated to a gaming machine 12 when the turnover of the gaming machine reaches a turnover milestone, when the turnover reaches each of a series of turnover milestones, when a special bet is placed, when a specific period of time has elapsed since a ticket was allocated, based on the number of games played on the gaming machine, or when a specific symbol or symbol combination occurs such as when one or more winning outcomes occur at the gaming machines. However, it will be understood that any suitable ticket allocation criteria are envisaged. In this embodiment, it will be understood that tickets 22 are allocated to a plurality of gaming machines 12, with each ticket 22 providing a gaming machine 12 with a stake in a lottery.

In this example, each ticket 22 includes a ticket identifier 24 which serves to distinguish the ticket 22 from all other tickets 22 in the current lottery, and a gaming machine identifier 26 indicative of the gaming machine 12 to which the ticket 22 is allocated.

In one embodiment, operation is such that a plurality of virtual tickets 22 are created by the ticket management system 16 and stored in a ticket memory 20.

In an alternative embodiment, operation is such that a plurality of actual tickets are created, for example by printing the tickets at the gaming machines 12.

A prize pool associated with the lottery may be created by allocating a credit amount from each gaming machine 12 to the lottery each time a ticket 22 is allocated to the gaming machine 12. For example, each gaming machine 12 may contribute a credit amount to the prize pool when the ticket 22 is allocated to the gaming machine 12. The credit amount may vary, for example the credit amount may increase as the number of allocated tickets 22 increases.

As an alternative, the prize pool may accumulate in other ways, for example based on gaming machine turnover, and tickets may be allocated to gaming machines 12 without the need for the gaming machines to contribute a credit amount.

In this embodiment, one or more tickets corresponding to a winning outcome are determined by carrying out a lottery draw, for example by randomly selecting at least one ticket. In an alternative embodiment, one or more tickets corresponding to a winning outcome are determined by randomly indicating on at least one ticket information indicative of whether the ticket corresponds to a winning outcome. With this embodiment, the tickets may be in the form of scratch cards.

Figure 2:
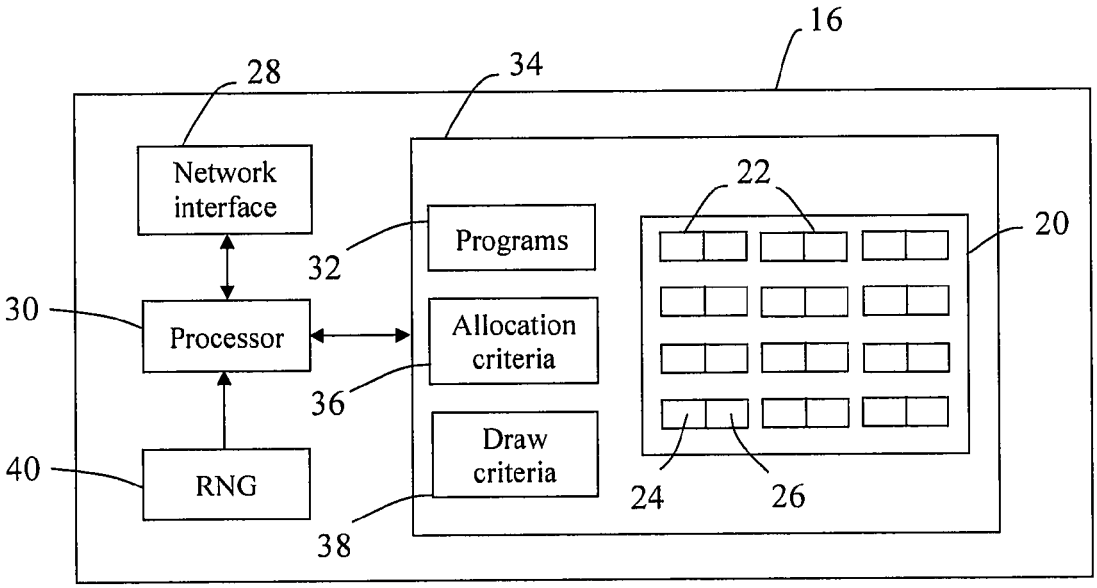
FIG. 2 is a schematic block diagram of components of a ticket control unit of the gaming system shown in FIG. 1.

Example operative components of the ticket management system 16 are shown in FIG. 2.

In the present example, the operative components include a network interface 28 which facilitates communications between the ticket management system 16 and the gaming machines 12 through the gaming network 14, and a processor 30 arranged to control and coordinate operations in the ticket management system 16 in accordance with programs 32 stored in a memory 34.

The programs in the memory 34 define operation in relation to ticket allocation criteria 36 which govern allocation of tickets 22 to the gaming machines 12, and in this example draw criteria 38 which govern ticket draws such as when and how many tickets to draw. In the present example, a predetermined number of tickets are created at commencement of the lottery, a ticket 22 is allocated to a gaming machine 12 when the turnover of the gaming machine reaches a predetermined milestone or each time the turnover reaches one of several predetermined milestones, and the ticket draw occurs when the prize pool reaches a predetermined amount. However, variations are possible. For example, the ticket management system 16 may be arranged so as to draw the lottery when a predetermined number of tickets have been allocated to the gaming machines 12, or the ticket management system 16 may be arranged so as to draw the lottery when a pseudo randomly selected number of tickets have been allocated when the prize pool reaches a pseudo randomly selected amount, or after a pseudo randomly defined period of time. For this purpose, the ticket management system 16 may also include a random number generator 40.

It will be understood that any number of tickets may be drawn in each lottery draw and that the amount of each prize may be fixed or variable for example by pseudo randomly selecting the prize amount.

In embodiments wherein the lottery is drawn prior to allocation of all available tickets 22, it is possible that not all available prizes will be won. With this arrangement, unallocated prizes may be carried over to the next lottery draw. In a variation of this embodiment, the ticket management system 16 may be arranged so as to carry out a lottery draw prior to allocation of the total number of allocatable tickets for n successive lottery draws, and on the (n+1)th draw to carry out the lottery draw only when all tickets have been allocated so that all prizes are won.

Figure 3:
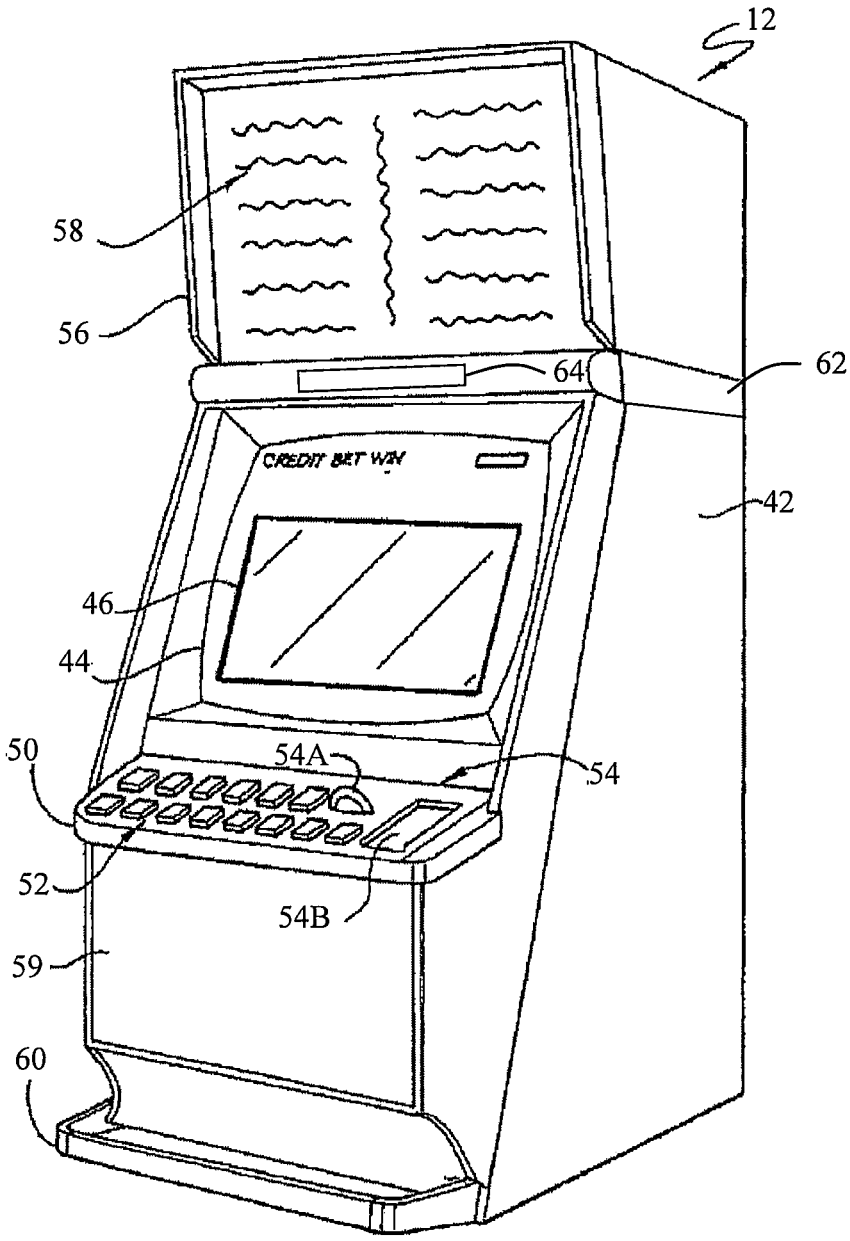
FIG. 3 is a diagrammatic representation of an example gaming machine of the gaming system shown in FIG. 1.

An example gaming machine 12 is illustrated in FIG. 3. The gaming machine 12 includes a console 42 having a display 44 on which is displayed representations of a game 46 that can be played by a player. A mid-trim 50 of the gaming machine 12 houses a bank of buttons 52 for enabling a player to interact with the gaming machine, in particular during game play. The mid-trim 50 also houses a credit input mechanism 54 which in this example includes a coin input chute 54A and a bill acceptor 54B. Other credit input mechanisms may also be employed, for example, a card reader for reading a smart card, debit card or credit card.

A top box 56 may carry artwork 58, including for example pay tables and details of bonus awards and other information or images relating to the game. Further artwork and/or information may be provided on a front panel 59 of the console 42. A coin tray 60 is mounted beneath the front panel 59 for dispensing cash payouts from the gaming machine 12.

The display 44 is in the form of a video display unit, particularly a cathode ray tube screen device. Alternatively, the display 44 may be a liquid crystal display, plasma screen, or any other suitable video display unit. The top box 56 may also include a display, for example a video display unit, which may be of the same type as the display 44, or of a different type.

The display 44 is arranged to display representations of several reels, each reel of which has several associated symbols. Typically 3, 4 or 5 reels are provided. During operation of the game, the reels first appear to rotate then stop with typically three symbols visible on each reel. Game outcomes are determined on the basis of the visible symbols together with any special functions associated with the symbols, and if a function has been allocated to a reel, on the basis of the allocated function.

Alternative gaming machines including physical reels, and gaming machines arranged to implement other types of games such as bingo, keno, card games, or pin and ball games are also envisaged.

A player marketing module (PMM) 62 having a display 64 is connected to the gaming machine 12. The main purpose of the PMM 62 is to allow the player to interact with a player loyalty system. The PMM has a magnetic card reader for the purpose of reading a player identification device, for example as part of a loyalty program. However other reading devices may be employed and the player tracking device may be in the form of a card, flash drive or any other portable storage medium capable of being read by the reading device. In this example, the PMM 62 is a Sentinel III device produced by Aristocrat Technologies Pty Ltd.

Figure 4:
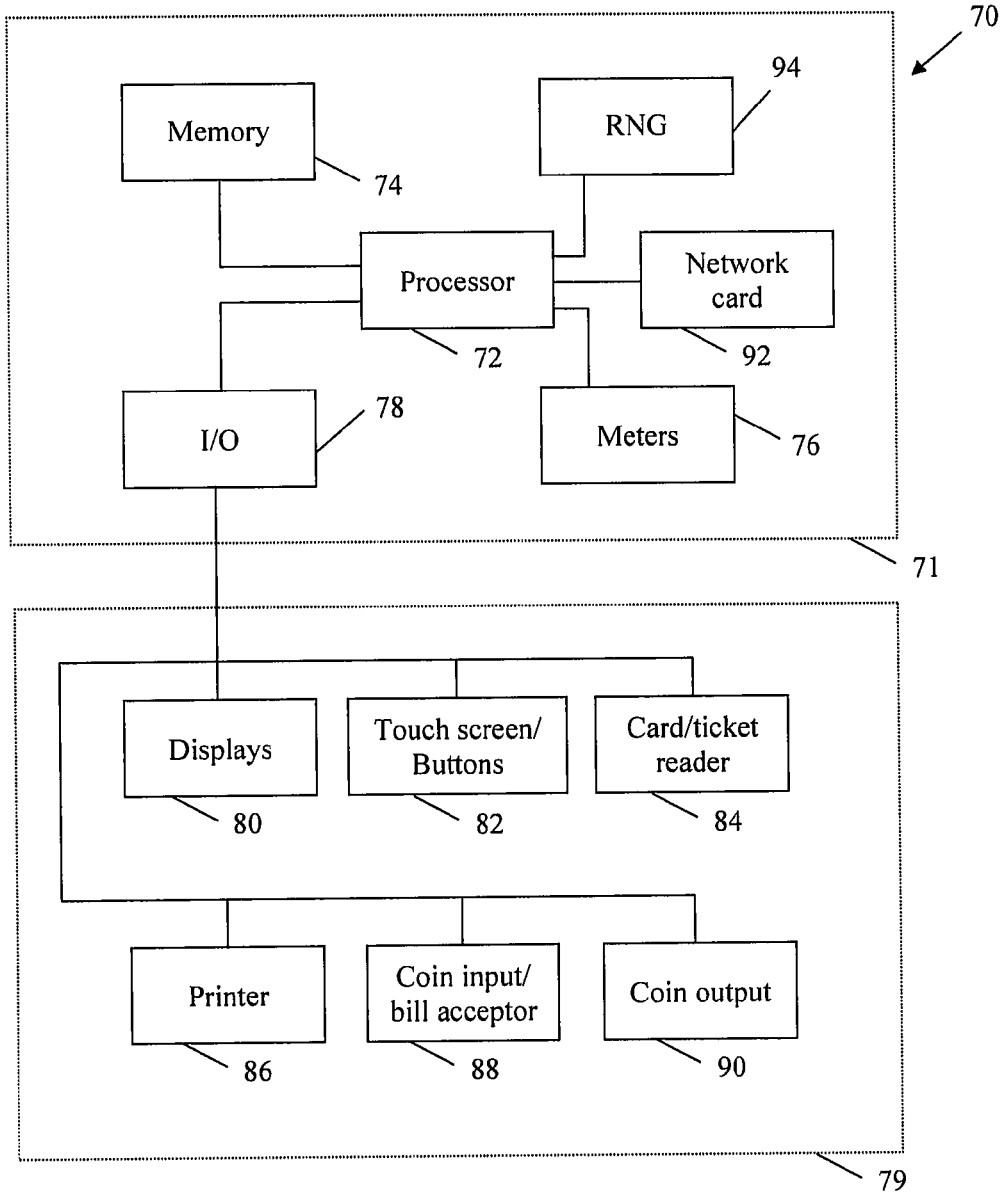
FIG. 4 is a schematic block diagram of operative components of the gaming machine shown in FIG. 3.

FIG. 4 shows a block diagram of example operative components 70 of the gaming machine 12 shown in FIG. 3.

The operative components 70 include a game controller 71 having a processor 72. Instructions and data to control operation of the processor 72 in accordance with the present invention are stored in a memory 74 which is in data communication with the processor 72.

Typically, the operative components 70 will include both volatile and non-volatile memory and more than one of each type of memory, with such memories being collectively represented by the memory 74.

Figure 5:
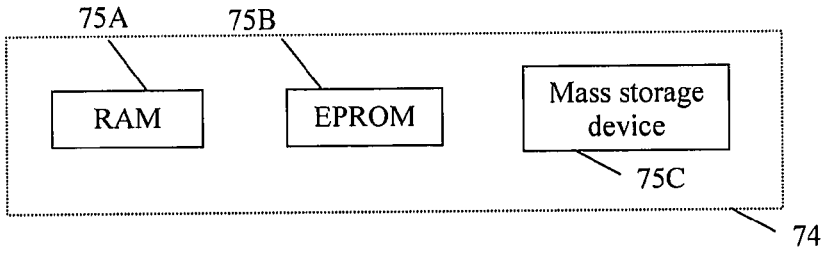
FIG. 5 is a schematic diagram of components of a memory of the gaming machine shown in FIG. 3.

FIG. 5 shows a block diagram of the main components of an exemplary memory 74. The memory 74 includes RAM 75A, EPROM 75B and a mass storage device 75C. The RAM 75A typically temporarily holds program files for execution by the processor 72 and related data. The EPROM 75B may be a boot ROM device and/or may contain some system or game related code. The mass storage device 75C is typically used to store game programs, the integrity of which may be verified and/or authenticated by the processor 72 using protected code from the EPROM 75B or elsewhere.

In this embodiment, the gaming machine also comprises hardware meters 76 for purposes including ensuring regulatory compliance and monitoring player credit, an input/output (I/O) interface 78 for communicating with a player interface 79 of the gaming machine 12, the player interface 79 having several peripheral devices. The input/output interface 78 and/or the peripheral devices may be intelligent devices with their own memory for storing associated instructions and data for use with the input/output interface or the peripheral devices. A random number generator module 94 generates random numbers for use by the processor 72.

In the example shown in FIG. 4, the peripheral devices that communicate with the game controller 71 comprise one or more displays 80, a touch screen and/or bank of buttons 82, a card and/or ticket reader 84, a printer 86, a bill acceptor and/or coin input mechanism 88 and a coin output mechanism 90. Additional hardware may be included as part of the gaming machine 12, or hardware may be omitted as required for the specific implementation.

In addition, the operative components 70 include a communications interface, for example a network card 92 which enables the gaming machine 12 to communicate with the gaming network 14.

Operation of the gaming system 10 will now be described with reference to flow diagram 100 shown in FIG. 6 which illustrates steps 102 to 114 of a method of gaming in accordance with an embodiment of the invention. In this embodiment, the gaming system is of a type arranged to create virtual tickets 22 and allocate the virtual tickets to a plurality of gaming machines.

Figure 6:
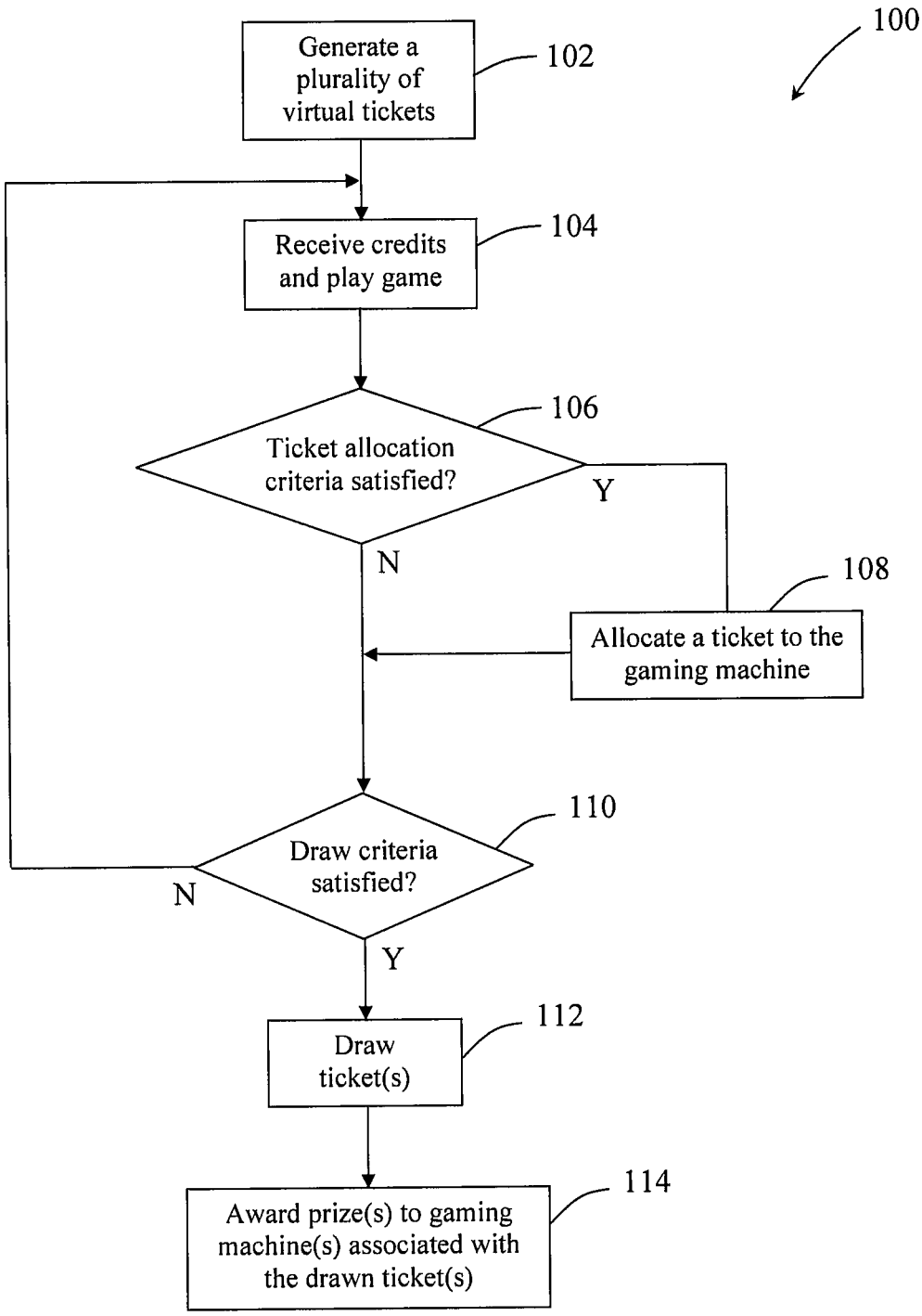
FIG. 6 is a flow diagram illustrating a method of gaming in accordance with an embodiment of the present invention.

As illustrated in FIG. 6, a plurality of virtual tickets 22 are first generated 102 by the ticket management system 16 in accordance with programs 32 stored in the memory 34, and based on ticket allocation criteria 36 stored in the memory 34 tickets are allocated 108 to the gaming machines 12 associated with the gaming system 10. Ticket allocation in this example is triggered by receipt at the ticket management system 16 of a communication from a gaming machine, for example indicative that the machine has reached a specific turnover threshold, and allocation occurs by sending an allocation communication from the ticket management system 16 to the gaming machine 12. When draw criteria 38 stored in the memory 34 are satisfied 110, for example when a pseudo randomly determined number of tickets 22 have been allocated, a predetermined number of virtual tickets 22 are drawn 112 and prizes are awarded 114 to players of gaming machines associated with the drawn tickets.

While the above embodiments are described in relation to a gaming system which includes a plurality of gaming machines and a ticket management system in networked relationship to the gaming machines, it will be understood that other arrangements are possible. For example, the or each gaming machine may include a ticket management system or some aspects of the ticket allocation system 16 so that game implementation including allocation of tickets and determining whether an allocated ticket corresponds to a winning outcome occur at the gaming machine. With this arrangement, it is not necessary to include in the tickets a gaming machine identifier 26

While the above embodiment is described in relation to a gaming system and a ticket management system which implements a lottery wherein tickets are distributed to participating gaming machines and at least one of the tickets is drawn to determine a winning ticket, other arrangements are envisaged. For example, the ticket management system 16 may be arranged so as to distribute tickets to participating gaming machines 12 with each ticket or at least some of the tickets having information indicative of an associated award included in the ticket. The award may be a credit award, one or more free games, a feature option, and so on.

In one embodiment, instead of providing virtual tickets actual tickets are printed at the gaming machines.

In one embodiment, the actual tickets are in a form such that the tickets themselves provide an indication to players as to whether an award has been received, for example in the form of scratch cards. In this way, drawing tickets to determine one or more winning tickets is not necessary.

It will also be understood that although the above embodiments are described in relation to a gaming system wherein on lottery type game is implemented, it is envisaged that multiple lottery type games may be implemented simultaneously. For example, a jackpot lottery may be implemented at the same time as a minor prize lottery, with different allocation criteria being used for the jackpot and minor prize lotteries.

It will also be appreciated that entitlement to receive tickets may be dependent on player loyalty criteria, for example such that only players interacting with the gaming machine using the PMM 62 are able to receive tickets.

Modifications and variations as would be apparent to a skilled addressee are deemed to be within the scope of the present invention.

The invention claimed is:

1. A ticket management system for a gaming system comprising a plurality of gaming machines, the ticket management system being arranged to:

determine, randomly, a fixed number of tickets to be allocated to the plurality of gaming machines;

allocate the randomly determined fixed number of tickets to the plurality of gaming machines in accordance with at least one allocation criterion;

draw one of the tickets 1) for each of n draws, prior to allocating all of the tickets to the gaming machines, and 2) for the (n+1)th draw, after all of the tickets have been allocated to the gaming machines, wherein said drawn tickets represent winning tickets; and award a player of one of the gaming machines a prize when a ticket allocated to the one of the gaming machines corresponds to one of said winning tickets.

2. A ticket management system as claimed in claim 1, wherein the ticket management system is arranged to:

draw at least one of the tickets when a draw criterion is satisfied.

3. A ticket management system as claimed in claim 2, and wherein the draw criterion includes a predetermined number of tickets less than the total number of available tickets have been allocated.

4. A ticket management system as claimed in claim 2, and wherein the draw criterion includes a pseudo randomly selected number of tickets less than the total number of available tickets have been allocated.

5. A ticket management system as claimed in claim 1, and wherein each of the tickets includes information indicative of whether the respective ticket corresponds to the winning ticket.

6. A ticket management system as claimed in claim 1, and wherein the prize is a credit prize, at least one feature award, or at least one free game.

7. A ticket management system as claimed in claim 1, and wherein each of the tickets is printed by one of the gaming machines.

8. A ticket management system as claimed in claim 1, and wherein each of the tickets is a virtual ticket.

9. A ticket management system as claimed in claim 1, and wherein said at least one allocation criterion includes a turnover of the gaming machine reaches a predetermined turnover milestone.

10. A ticket management system as claimed in claim 1, further comprising a prize pool, the ticket management system being arranged so as to increase the prize pool as the number of allocated tickets increases.

11. A ticket management system as claimed in claim 10, wherein each of the gaming machines contributes a credit amount to the prize pool when a ticket is allocated to the respective gaming machine.

12. A method of gaming for use with a plurality of gaming machines and a gaming controller, the method comprising:

randomly determining, via the gaming controller, a fixed number of tickets to be allocated to the plurality of gaming machines;

allocating, via the gaming controller, the determined fixed number of tickets to the plurality of gaming machines in accordance with at least one allocation criterion;

drawing, via the gaming controller, one of the tickets 1) for each of n draws, prior to allocating all of the tickets to the gaming machines, and 2) for the (n+1)th draw, after all of the tickets have been allocated to the gaming machines, wherein said drawn tickets represent winning tickets; and awarding a prize to a player of one of the gaming machines when a ticket allocated to the one of the gaming machines corresponds to one of said winning tickets.

13. A method as claimed in claim 12, comprising:

drawing at least one of the tickets when a draw criterion is satisfied.

14. A method as claimed in claim 12, and wherein the draw criterion includes a predetermined number of tickets less than the total number of available tickets have been allocated.

15. A method as claimed in claim 12, and wherein the draw criterion includes a pseudo randomly selected number of tickets less than the total number of available tickets have been allocated.

16. A method as claimed in claim 12, comprising providing each of the tickets with information indicative of whether the respective ticket corresponds to the winning ticket.

17. A method as claimed in claim 12, wherein the prize is a credit prize, at least one feature award, or at least one free game.

18. A method as claimed in claim 12, comprising printing each of the tickets by one of the gaming machines.

19. A method as claimed in claim 12, wherein each of the tickets is a virtual ticket.

20. A method as claimed in claim 12, and wherein said at least one allocation criterion includes a turnover of the gaming machine reaches a predetermined turnover milestone.

21. A method as claimed in claim 12, comprising providing a prize pool and increasing the prize pool as the number of allocated tickets increases.

22. A method as claimed in claim 21, comprising contributing a credit amount to the prize pool from each of the gaming machines when a ticket is allocated to the respective gaming machine.

* * * * *

UNITED STATES PATENT AND TRADEMARK OFFICE

CERTIFICATE OF CORRECTION

PATENT NO. : 8,579,691 B2
APPLICATION NO. : 12/139247
DATED : November 12, 2013
INVENTOR(S) : Jones et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 833 days.

Signed and Sealed this
Seventh Day of April, 2015

Michelle K. Lee

Michelle K. Lee
*Director of the United States Patent and Trademark Office*